United States Patent [19]

Chulay et al.

[11] 4,076,170

[45] Feb. 28, 1978

[54] TUBE CAP ASSEMBLY FOR PREPARATIVE CENTRIFUGE ROTORS

[75] Inventors: Steven John Chulay, Los Altos; Victor John Grilli, Mountain View, both of Calif.

[73] Assignee: Beckman Instruments, Inc., Fullerton, Calif.

[21] Appl. No.: 788,484

[22] Filed: Apr. 18, 1977

[51] Int. Cl.[2] ..... B04B 15/00

[52] U.S. Cl. ..... 233/26

[58] Field of Search ..... 233/1 R, 1 A, 26; 210/DIG. 23, DIG. 24

[56] References Cited

U.S. PATENT DOCUMENTS

| | | | |
|---|---|---|---|
| 3,133,882 | 5/1964 | Mitchell et al. | 233/26 |
| 3,434,615 | 3/1969 | Barletta | 233/26 X |
| 3,459,369 | 8/1969 | Marks | 233/26 |
| 3,938,735 | 2/1976 | Wright et al. | 233/26 |
| 3,998,383 | 12/1976 | Romanauskas et al. | 233/26 |
| 4,015,775 | 4/1977 | Rohde | 233/26 |

*Primary Examiner*—George H. Krizmanich
*Attorney, Agent, or Firm*—Robert J. Steinmeyer; Ferd L. Mehlhoff; William H. May

[57] ABSTRACT

A test tube cap assembly for centrifuge rotor tubes. A stem member slidably moves within a crown member to exert a direct force on a bushing to securely grip the upper portion of a test tube located within the crown member. The stem member and the bushing have generally mating frustoconical surfaces to provide a wedging action on the upper portion of the test tube. The wedging action serves to not only seal the tube, but also support the upper end of the test tube by restraining the centipetal side of the tube from pulling away from the cap. The operation of the cap assembly is enhanced by the hydraulic forces exerted from within the test tube by the contained liquid.

10 Claims, 3 Drawing Figures

TUBE CAP ASSEMBLY FOR PREPARATIVE CENTRIFUGE ROTORS

BACKGROUND OF THE INVENTION

This invention relates to test tube cap assemblies designed to seal and support the upper end of a test tube during centrifugation. More specifically, this invention is directed to an improved test tube cap assembly sealing and support arrangement designed for use with rotors which experience considerable hydraulic pressure at the interface between the test tube and the cap assembly.

The test tubes normally utilized in high speed centrifuge rotors have a thin wall construction and, therefore, are subjected to deformation as a result of centrifugation forces when there is not adequate liquid support within the test tube.

In the case of centrifuge rotors having pivotal test tube cavities, the longitudinal axis of each tube assumes an angle that is substantially perpendicular to the spin axis of the rotor. The rotor tube cavity is closed by means of a cap and seal, but the functioning of neither of these components is affected by the tube or its contents. In effect, the upper end of the tube is unconstrained by a tube cap. The tube, however, must contain sufficient liquid to support the interior of the upper end of the tube to prevent it from buckling under its own centrifugal weight. The liquid level in the tube has no bearing on the integrity of the seal in these pivotal test tube cavity rotors.

However, in the case of other rotors the longitudinal axis of the test tube cavities is at an angle less than 90° with the rotational axis of the rotor. For such rotors it is necessary to provide a tube cap which not only seats, but also supports the upper end of the tube against the action of centrifugal force. Generally, the contained liquid does not completely fill the test tube and/or the tube stretches to fill its rotor cavity, resulting in the formation of an air pocket at the centripetal side of the test tube. The centrifugal forces acting on the centripetal side of the test tube will tend to pull the upper portion of the test tube out of the tube cap at the centripetal side of the rotor cavity, causing the seal to fail.

During centrifugation the test tube cap and tube assembly interface will experience some hydraulic pressure from the fluid therein in conjunction with the centrifugal forces that also tend to pull the upper end of the tube out of the tube cap. Consequently, test tube cap arrangements had to be devised to resist the forces which tend to cause leakage and/or tube collapse. Examples of such prior art approaches to avoid such problems in a fixed angle rotor during centrifugation are disclosed in Galasso et al. U.S. Pat. No. 3,447,712, Marks U.S. Pat. No. 3,459,369 and Wright et al. U.S. Pat. No. 3,938,735.

When the angle of the longitudinal axis of the test tube with respect to the rotational axis of the rotor decreases toward zero, the hydraulic forces exerted on a tube cap assembly become significantly greater, requiring greater sealing or counter forces to prevent leakage of the fluid sample and to prevent tendency of the tube to pull out of the centripetal side of the cap. One approach to counter the higher hydraulic forces is the use of a plug threadedly mounted within the rotor test tube cavity over the test tube cap assembly. A patent application entitled Dual Seal Arrangement for a Centrifuge Rotor Tube Cavity, Ser. No. 715,117 filed Aug. 17, 1976 by Roger Anderson and John Edwards uses a secondary seal between such a plug and the tube cap to provide greater assurance that any seepage from the test tube itself would be contained within the rotor and not escape the rotor during centrifugation. However, there is still the concern and desire to always contain the fluid sample completely within the test tube and avoid any leakage out of the test tube. Otherwise, the integrity of the centrifugation run would be destroyed.

In some rotors the test tubes have been vertically oriented, so that the longitudinal axis of the test tube is essentially parallel to the rotational axis of the rotor. However, the hydraulic forces exerted by the fluid sample on a test tube cap assembly are greatly increased, accentuating potential leakage problems of the fluid sample. Hence, there is a need for an uncomplicated, but secure seal in a tube cap assembly for vertical or nearly vertical tube rotors.

SUMMARY OF THE INVENTION

The present invention has a crown member with a stem member slidably mounted therein for engagement with a bushing. Movement of the stem closer to the crown exerts a biasing force on the bushing and forces it against the upper portion of the test tube for securing the test tube within the crown. The lower end of the stem and the bushing having specifically designed sloping surfaces which are designed to provide a greater securing seal on the upper portion of the test tube than in any of the prior art arrangements. This design of the stem in conjunction with the bushing is such that it will utilize the hydraulic forces exerted by the liquid within the test tube to automatically compensate for these forces and provide a greater seal and gripping action within the cap assembly.

The bushing has an interior slanted surface that receives the biasing end of the stem to create the securing force on the test tube within the crown member. Since the lower edge of the stem member has a dimension greater than the interior dimension of the bushing, upward movement of the stem within the bushing produces a direct biasing force on the bushing which is exerted against the test tube to pinch it between the bushing and the crown member. Consequently, the present configuration provides a secure sealing arrangement in the cap assembly, so that leakage will be prevented regardless of the combined effects of the hydraulic forces of the contained liquid and the deformation forces of the test tube. As any hydraulic forces of the liquid are increased interior to the test tube, these forces are exerted upwardly against the lower end of the stem. This will contribute proportionately to the sealing of the test tube within the crown by increased pinching of the test tube between the bushing and crown. Therefore, any greater stress placed upon the sealing interface between the test tube and the cap assembly is countered by an automatic increased sealing force on the upper portion of the test tube.

The hydraulic force exerted in the test tube in a direction parallel to the spin axis is greater at the outboard or centrifugal portion of the cap than at the inboard or centripetal portion of the cap. As this force causes the stem to move upward relative to the bushing, the hydraulic force effects an intensified squeezing action around the entire sealing zone. Although the hydraulic pressure is zero at the most centripetal region of the liquid in the tube, this region is subjected to the greatest tendency in the tube to pull away from the cap. However, the overall action of the hydraulic force on this cap will provide additional clamping force all around the upper part of the tube to retain the tube secured within the cap.

DETAILED DESCRIPTION OF THE INVENTION

Figure 1:
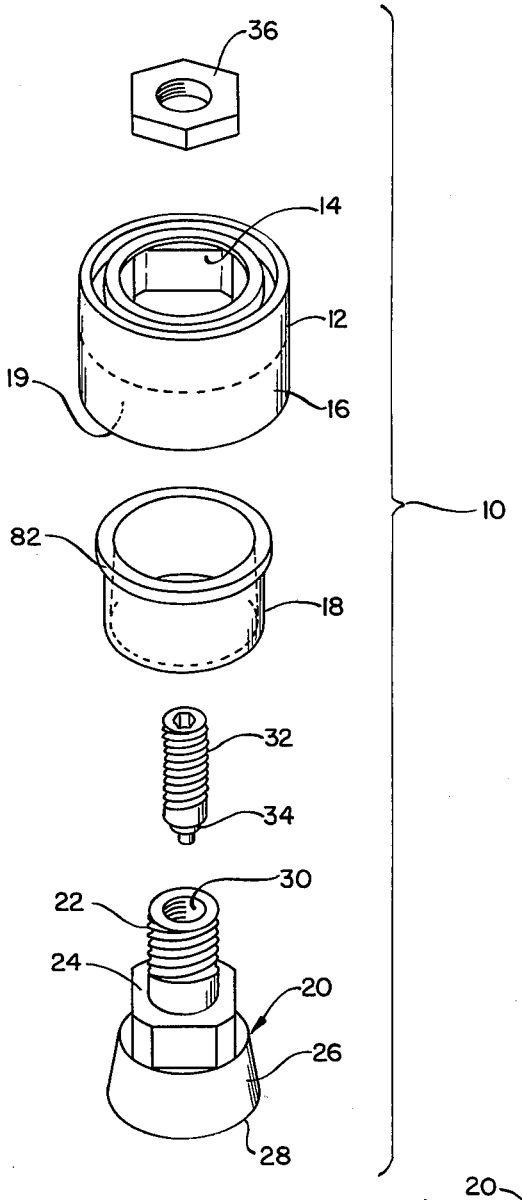
FIG. 1 is a perspective exploded view of the test tube cap assembly.

The test tube cap assembly 10 is shown in FIG. 1 having a crown 12 with a generally square aperture 14 and a depending skirt 16. A bushing member 18 is designed to fit in the crown within the recess 19 which is formed by the skirt 16. Movably mounted within the crown member 12 is a stem member 20 having a threaded control end 22 which is positioned within the aperture 14 of the crown 12. It should be noted that the stem 20 has a generally square throat section 24 which is designed to mate with the generally square aperture 14 in the crown to prevent any relative rotational motion of the stem with respect to the crown when tightening or loosening the cap assembly 10. The lower or biasing end 26 of the stem 20 has a frustoconical shape with its lower edge 28 having a diameter greater than any other part of the stem 20.

Located within the stem 20 is a central access channel or opening 30. Threadably received within this channel 30 is a filling screw 32 having a seal 34 to prevent any leakage through this central open channel 30. A nut 36 is designed to be threadably engaged with the control or upper end 22 of the stem to move the stem relative to the crown 12 as will be explained.

Figure 2:
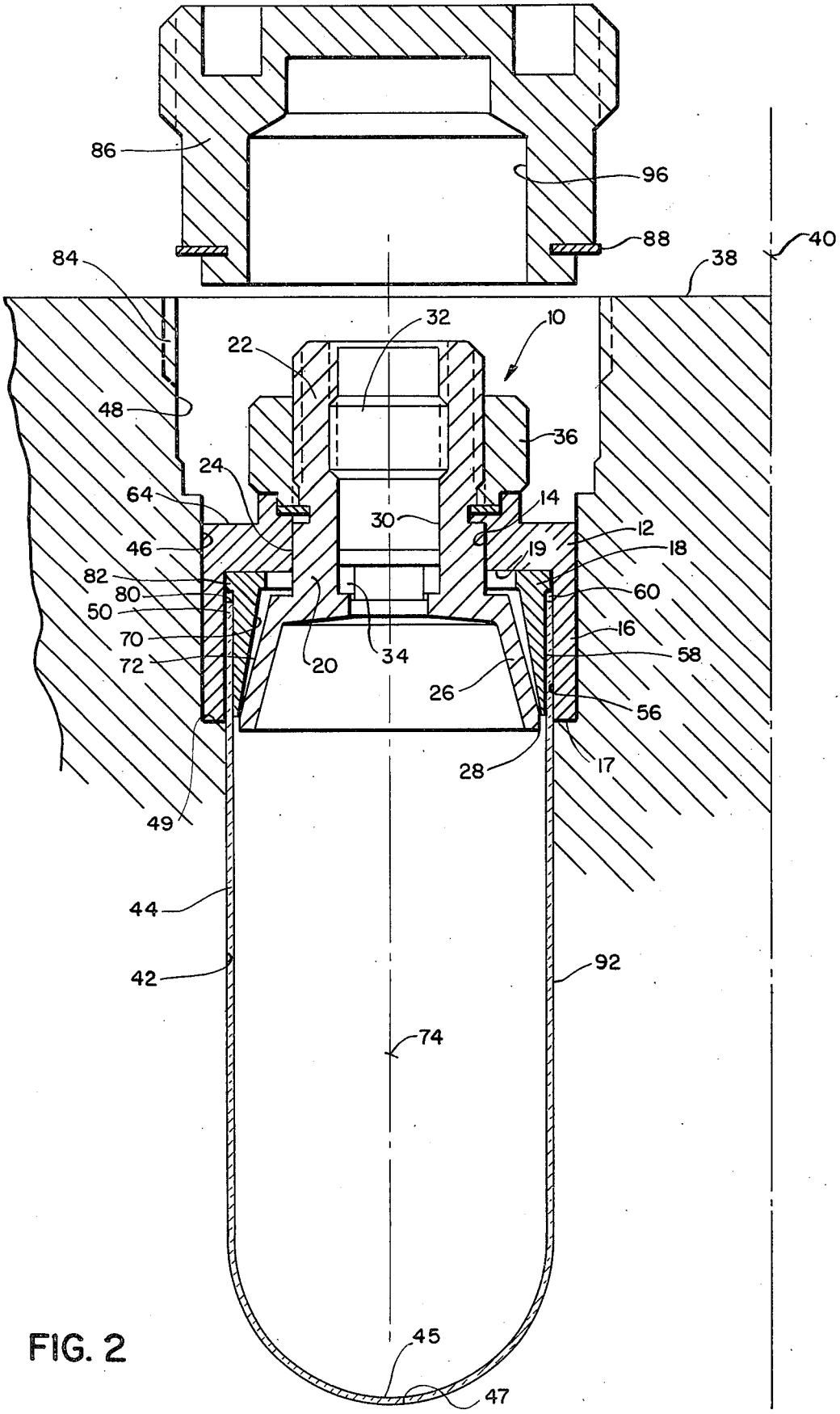
FIG. 2 is a sectional view of the test tube cap assembly mounted on a test tube within a rotor.

In FIG. 2 a portion of a rotor 38 is shown with a rotational axis 40. Located within the rotor is a vertical cavity 42 designed to receive a test tube 44. Located above the test tube cavity 42 is a first counterbore area 46 and a second counterbore area 48. Located on the upper portion 50 of the test tube 44 is the test tube cap assembly 10. The bushing 18 is positioned within a cavity or recess 19 formed by the depending skirt 16 of the crown member 12. It should be noted that the interior surface 56 of the skirt 16 and the exterior surface 58 of the bushing 18 form an annular cavity or channel 60 designed to receive the upper portion 50 of the test tube 44.

The stem 20 is placed within the crown member 12 with the neck 24 of the stem being positioned within the aperture 14 of the crown. The upper portion or control end 22 of the stem extends above the top 64 of the crown. The control nut 36 is threadably engaged with the upper portion 22 of the stem to provide a mechanism for moving the stem up and down relative to the crown with respect to FIG. 2. The lower end 26 of the stem is designed to be recessed completely within the skirt 16 of the crown 12.

Figure 3:
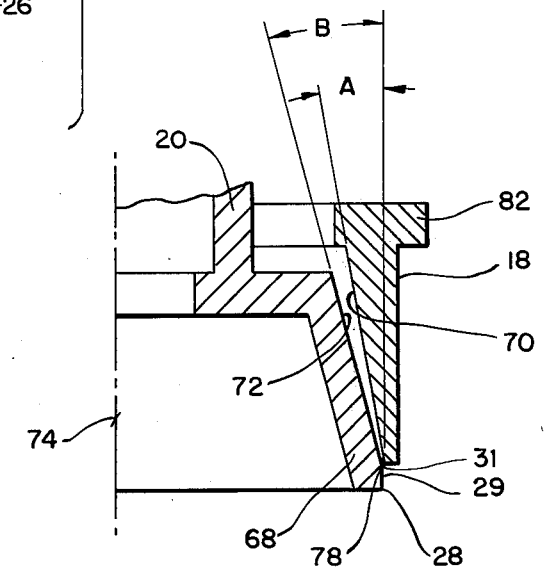
FIG. 3 is a partial sectional view of the stem member and the bushing showing their respective inclined surfaces.

The lower or biasing end 26 of the stem has a general frustoconical shape. Also the interior surface 70 of the bushing 18 has a frustoconical shape. FIG. 3 shows the relative amount of incline of the frustoconical outer surface 72 of the biasing end 26 of the stem with respect to the inner frustoconical surface 70 of the bushing 18. It should be noted that the preferable angle A of incline on the interior surface 70 of the bushing 18 with respect to the longitudinal axis 74 of the test tube 44 is approximately 10°. On the other hand, the preferable angle B of incline of the outer frustoconical surface 72 of the lower end 26 of the stem 20 with respect to the longitudinal axis 74 of the test tube is approximately 15°. It should be noted that the diameter of the outer edge 28 of the lower end 26 of the stem 20 is greater than the diamater of the lower edge 78 of the inner surface 70 of the bushing 18. The lower outer edge 28 of the stem 20 has a small flat portion or land 29 which eliminates the presence of a sharp edge.

With respect to the bushing 18 in FIG. 2, it should be noted that it has a flange or lip 82 which is designed to rest on the upper edge 80 of the test tube 44 and prevent the bushing 18 from slipping into the test tube 44 during disengagement of the test tube cap from the test tube.

As shown in FIG. 2, the first counterbore area 46 in the rotor 38 is designed to receive the crown 12. The second counterbore area 48 has a threaded portion 84 designed to threadably engage with a plug 86 (shown removed from the rotor). This plug is designed to provide a restraining or counter force to any forces exerted by the fluid sample on the tube cap during centrifugation. A secondary seal 88 is positioned below the plug 86 to provide a means for preventing the escape of any fluid from the rotor which may leak from the test tube 44. The plug has a cavity 90 to receive the control nut 36 and upper portion 22 of the stem when the plug 86 is threadably engaged within the second counterbore 48 of the rotor.

Turning to the operation of the present invention, attention is directed to FIG. 2. The assembled test tube cap 10 is placed on the upper portion 50 of the tube by placing the upper portion of the tube within the open channel 60 formed between the outside surface 58 of the bushing 18 and the interior surface 56 of the skirt 16 in the crown member 12. The cap is pushed down onto the tube until the bottom 17 of the skirt 16 is properly situated relative to the bottom 47 of the cavity 42. This relative positioning is important, because, when the tube with the cap is placed in the rotor, there should be no gap between the bottom 45 of the tube and the bottom 47 of the cavity 42. Otherwise, the tube would be subjected to distortion during centrifugation and the tube may tend to pull away from the cap.

The proper positioning is accomplished by mounting the cap on the tube either in the rotor itself or in an assembly fixture. When the mounting is done in the rotor and the bottom 45 of the tube is seated on the bottom 47 of the cavity 42, the bottom 17 of the skirt contacts the shoulder 49 of the cavity 42 to determine the proper relative positioning between the skirt and the bottom 47 of the cavity 42. The fluid placed in the tube prior to the mounting of the cap 10 on the tube 44 should generally fill the entire enclosed volume within the tube when the cap 10 is secured to the tube.

The control nut 36 is then torqued down on the upper end 22 of the stem 20 to cause the stem to move relative to the crown 12 in a first direction away from the bottom 45 of the test tube 44. This causes the lower outermost edge 28 in FIG. 3 of the frustoconical lower portion 26 of the stem to bite into the interior surface 70 of the bushing 18. As a result, the force exerted by the stem biasing end 26 against the bushing is directly transferred to a pinching or gripping force on the test tube against the interior surface 56 of the skirt 16 in the crown. The lower portion 26 of the stem actually provides a biting or tight seal through the bushing against the test tube 44. Because the lower edge 28 of the stem has a greater diameter than the interior surface 70 of the bushing, it will provide a narrow or thin band of a sealing junction on the test tube to provide an even greater force exerted within a small area of the upper portion of the test tube 50.

During centrifugation, any upwardly exerted forces from the fluid sample within the test tube against the cap assembly 10 will increase the biting or securing force of the stem lower portion 26 against the test tube. Consequently, the cap assembly seal is designed to automatically accommodate additional forces exerted during centrifugation causes by the hydraulic pressure exerted from within the test tube.

Since there is a slight gap between the top edge 80 of the test tube and the level of fluid placed in the test tube, a small air layer exists adjacent the inboard side 92 of the test tube. Therefore, adequate support to the thin walled test tube 44 is lacking and will result in a slight deformation of the test tube 44 along its inboard or centripetal side 92. Consequently, there will be a tendency for the upper portion 50 of the test tube adjacent the inboard side to pull downward from the cap assembly 10. The increased hydraulic forces exerted by the fluid against the cap assembly 10 during centrifugation will provide a greater seal to counter this tendency of the test tube to pull away from the cap assembly when the test tube has a slight deformation.

It should be noted that the plug 86 is threadably mounted within the second counterbore section 48 of the rotor cavity to provide a biasing or restraining force against the rotor cap which is being subjected to significant hydraulic forces from the fluid from within the test tube 44.

Once the centrifugation operation has been completed, the plug 86 is removed to allow removal of the test tube cap assembly 10 and the test tube 44. The removal is done carefully to avoid any possible jarring or remixing of the centrifuged fluid sample. The filling screw 32 is removed from within the central aperture 30 of the stem. Consequently, the centrifuged liquid can be removed from the test tube prior to removal of the cap assembly 10.

The control nut 36 is loosened from the upper end 22 of the stem to allow the stem to be pushed downward slightly toward the bottom 45 of the test tube. Since interaction of the flange 82 on the bushing 18 with the top face 80 of tube 50 restrains the bushing 18 from moving downward with the stem 20, this will result in the lower end 26 of the stem moving away from the bushing 18 and releasing the biasing force against the bushing and upper portion 50 of the test tube.

Since the bushing 18 is preferably made of a pliable material which had previously been expanded by the stem, it will tend to return to its original shape to open the channel 60 and allow the test tube 44 to be removed from the test tube cap assembly 10.

In FIG. 3 the angle B of the frustoconical outer surface 72 of the lower end 26 of the stem is greater than the angle A of the interior surface 70 of the bushing 18. A lower portion 31 of the frustoconical surface 72 is the main contact area with the interior 70 of the bushing. This results in a greater force being exerted at a single narrow band directed against the test tube to ensure greater sealing. Otherwise, if the angles B and A of the frustoconical surfaces 72 of the stem and 70 of the bushing 18 respectively were equal or mating, the force would be exerted over a greater area against the upper portion 50 of the test tube, resulting in a less concentrated sealing force against the test tube.

Also it should be noted that during centrifugation and when the stem 20 is in its sealing position with respect to the crown 12, the lower end 26 of the stem is completely within the skirt 16 of the crown 12. Therefore, the combination of the lower portion of the stem 26 with the bushing 18 and the skirt 16 of the crown provides greater combined support among the elements in the cap assembly to prevent possible deformation of the cap assembly when subject to the extreme forces of high speed centrifugation.

What is claimed is:

1. A centrifuge test tube cap assembly for a thin test tube, said assembly comprising:

a crown member with a depending outer flange forming a generally cylindrical cavity, said crown member having a central aperture;

a stem member movably mounted within said aperture of said crown member, said stem member having a biasing end positioned within said cylindrical cavity; and a bushing member positioned within said cavity between said biasing end of said stem member and said depending outer flange of said crown member, said bushing member having a frustoconical interior surface, the top edge portion of said test tube being positioned within said cavity between said depending flange and said bushing member, said biasing end of said stem member having a diameter generally greater than the largest diameter of said frustoconical interior surface of said bushing member, movement of said stem member in a first direction causing said biasing end to force said bushing member to tightly secure said test tube against the interior surface of said depending flange and movement of said stem member in a second direction opposite said first direction causing said biasing end to release said bushing member allowing said top edge portion of said test tube to be released from said tube cap assembly.

2. A centrifuge test tube cap assembly as defined in claim 1 wherein said bushing has an upper outwardly extending lip to abut the top edge of said test tube during removal of said cap assembly from said tube to prevent said bushing from moving as a unit with said stem member.

3. A centrifuge test tube cap assembly as defined in claim 1 wherein said bushing is elastically pliable, said movement of said stem member is said first direction expanding said bushing to force said bushing tightly against said upper portion of said test tube to secure said test tube between said bushing and said skirt.

4. A centrifuge test tube cap assembly as defined in claim 1, wherein said biasing end of said stem has a frustoconical outer surface.

5. A centrifuge test tube cap assembly as defined in claim 4 wherein said frustoconical outer surface of said biasing end of said stem has a greater angle of slope with respect to a central longitudinal axis of said test tube than the angle of slope of said frustoconical interior surface of said bushing with respect to said axis of said test tube.

6. A centrifuge test tube cap assembly as defined in claim 5 wherein said angle of slope of said frustoconical outer surface of said biasing end of said stem approximately 15°.

7. A centrifuge test tube cap assembly as defined in claim 5 wherein said angle of slope of said frustoconical interior surface of said bushing member is approximately 10°.

8. A centrifuge test tube cap assembly as defined in claim 1 and additionally comprising means for moving said stem in said first and second directions relative said crown.

9. A centrifuge test tube cap assembly for a thin test tube, said assembly comprising:

a crown member having a generally cylindrical depending skirt forming a recess;

a stem member slidably mounted within said crown member and having a biasing end located in said recess;

a bushing member positioned adjacent the interior surface of said skirt, said bushing and said skirt forming an annular channel for receipt of the upper portion of said test tube, said bushing member having tapered inside surface with said bushing being thinnest at its end remote from the top of said crown member, said biasing end of said stem member having a diameter at its end remote from said top of said crown greater than the inner diameter of said bushing at its thinnest portion; and means for moving said stem member in one direction and an opposite direction relative to said crown member, movement of said stem in said one direction causing said biasing end of said stem to force said bushing outward against said upper portion of said test tube to secure it against said interior surface of said skirt, said remote end of said biasing end of said stem establishing a narrow sealing band between said bushing and said test tube on said skirt to establish a concentrated sealing force against said test tube, movement of said stem in said opposite direction releasing said biasing end of said stem from said bushing to allow said test tube to be released from said cap assembly.

10. A centrifuge test tube cap assembly for a thin wall test tube, said assembly comprising:

a crown member having a generally cylindrical depending skirt forming a cup for receipt of the upper portion of said test tube;

a stem movably mounted within said crown member and having a biasing end located within said recess;

a bushing located within said recess between said biasing end of said stem and said portion of said test tube; and means for moving said biasing end relative said crown member to force said bushing against said upper portion of said test tube to secure said test tube within said skirt, said biasing end of said stem, when sealing the upper portion of said test tube, being recessed completely within said skirt to alleviate potential distortion of said stem during centrifugation.

* * * * *

UNITED STATES PATENT AND TRADEMARK OFFICE

CERTIFICATE OF CORRECTION

PATENT NO. : 4,076,170

DATED : February 28, 1978

INVENTOR(S) : Chulay et al.

It is certified that error appears in the above-identified patent and that said Letters Patent are hereby corrected as shown below:

| | |
|---|---|
| Column 7, line 1, | after "stem" insert the word --is-- |
| Column 7, lines 21-22, | after "having" insert the word --a--. |

Signed and Sealed this

*Sixth* Day of *June 1978*

[SEAL]

*Attest:*

RUTH C. MASON
*Attesting Officer*

DONALD W. BANNER
*Commissioner of Patents and Trademarks*